United States Patent [19]

Baron et al.

[11] 4,046,270

[45] Sept. 6, 1977

[54] POWER SHOVEL AND CROWD SYSTEM THEREFOR

[75] Inventors: George B. Baron; Paul W. Padrutt, both of Marion, Ohio

[73] Assignee: Marion Power Shovel Company, Inc., Marion, Ohio

[21] Appl. No.: 704,935

[22] Filed: July 12, 1976

Related U.S. Application Data

[63] Continuation of Ser. No. 477,022, June 6, 1974, abandoned.

[51] Int. Cl.[2] ..... E02F 3/32

[52] U.S. Cl. ..... 214/138 R; 60/413

[58] Field of Search ..... 214/138 R, 762, 142; 60/413, 416, 465, 487

[56] References Cited

U.S. PATENT DOCUMENTS

| | | | |
|---|---|---|---|
| 3,363,792 | 1/1968 | Hoppe | 214/142 |
| 3,393,509 | 7/1968 | Kempson | 60/465 |
| 3,501,034 | 3/1970 | Baron | 214/138 |
| 3,581,919 | 6/1971 | Karlsson | 214/138 |
| 3,779,135 | 12/1973 | Sugimura | 60/413 |
| 3,856,161 | 12/1974 | Baron | 214/138 R |

FOREIGN PATENT DOCUMENTS

| | | | |
|---|---|---|---|
| 1,231,585 | 5/1971 | United Kingdom | 60/413 |

*Primary Examiner*—Robert J. Spar
*Assistant Examiner*—Ross Weaver
*Attorney, Agent, or Firm*—Mason, Fenwick & Lawrence

[57] ABSTRACT

A power shovel comprising a body; a front end assembly mounted on the body including a dipper; means for crowding the dipper; means for hoisting the dipper; and an energy regeneration system including an energy storing means and means actuated by a predetermined movement of at least one component of the front end assembly for charging the energy storing means, the energy storing means providing in the loaded condition a force applicable to a component of the front end assembly for at least biasing such component toward a predetermined movement.

44 Claims, 6 Drawing Figures

POWER SHOVEL AND CROWD SYSTEM THEREFOR

This is a continuation of application, Ser. No. 477,022, filed June 6, 1974, now abandoned.

This invention relates to a power shovel and more particularly to a power shovel having improved operating efficiency. This invention further contemplates a novel crowd system for a power shovel.

In conventional power shovels, there usually is provided a main frame rotatably mounted on a crawler unit, a front end assembly including a dipper mounted on the main frame, a system mounted on the main frame and operatively connected to the front end assembly for crowding the dipper into a deposit of material being excavated, and a system usually mounted on the main frame and operatively connected to the front end assembly for hoisting the dipper. In the operation of such shovels, a considerable amount of energy is consumed, a substantial portion of which is wasted. It thus has been found to be desirable to provide a power shovel in which the amount of energy consumed may be reduced without a corresponding reduction in the work performed by the machine, thus increasing the operating efficiency of the shovel.

Accordingly, it is the principal object of this invention to provide a novel power shovel.

Another object of the present invention is to provide a novel power shovel having smaller energy input requirements than comparable power shovels in the prior art.

A further object of the present invention is to provide a novel power shovel requiring a comparatively smaller amount of energy input without a corresponding sacrifice in work output thus increasing the operating efficiency of the shovel.

A still further object of the present invention is to provide a novel power shovel requiring a comparatively smaller amount of energy input without corresponding reduction in work output which is comparatively simple in design and reliable in performance.

Another object of the present invention is to provide a novel crowd system for a power shovel.

A further object of the present invention is to provide a novel crowd system for a power shovel, requiring a comparatively smaller amount of energy input without a corresponding reduction in work output.

A still further object of the present invention is to provide a novel energy storing system for a power shovel.

Another object of the present invention is to provide a novel fluid actuating system for a power shovel.

Other objects and advantages of the present invention will become more apparent to those persons having ordinary skill in the art to which the present invention pertains, from the following specification, taken in conjunction with the accompanying drawings wherein.

Figure 1:
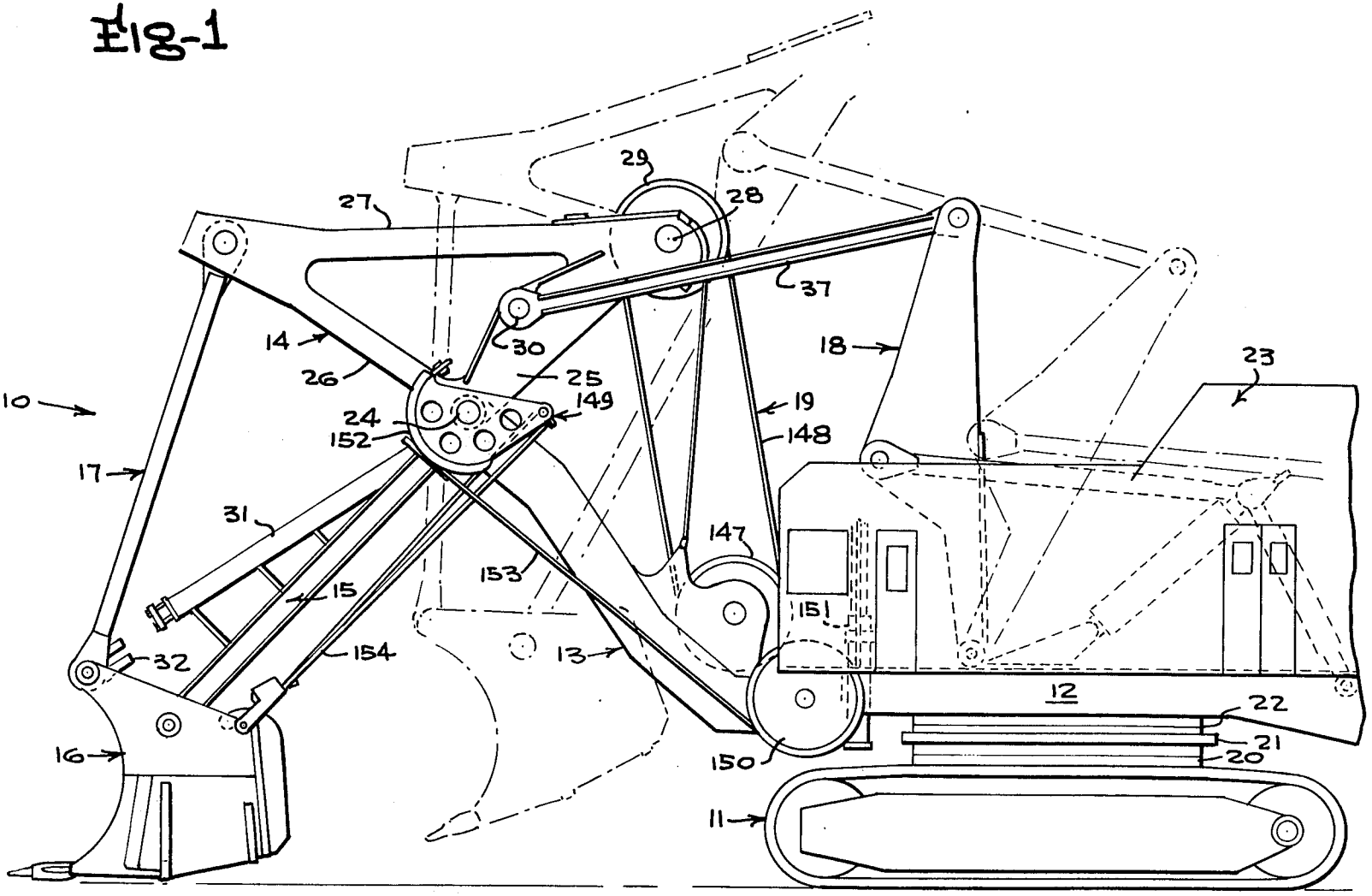
FIG. 1 is a side elevational view of a power shovel embodying the invention.

Referring to the drawings, there is illustrated a power shovel 10 generally including a crawler unit 11, a main frame 12 rotatably mounted on the crawler unit, a stiffleg 13 pivotally connected at its lower end to the main frame, a hoist frame 14 pivotally connected to the upper end of stiffleg 13, a dipper handle 15 pivotally connected to the outer end of stiffleg 13 (although the dipper handle alternatively may be pivotally connected to hoist frame 14), a dipper 16 pivotally connected to the outer end of dipper handle 15, a hoist link 17 pivotally connected to hoist frame 14 and dipper 16, a crowd system 18 mounted on main frame 12 and operatively connected to hoist frame 14, and a hoist mechanism 19 mounted on main frame 12 and operatively connected to hoist frame 14.

Crawler unit 11 may be of any conventional design and has mounted thereon a lower frame 20 which supports a conventional roller circle 21. An upper frame 22 is seated on the roller circle and is adapted to support main frame 12. Appropriate machinery is provided on main frame 12 to drive the crawler unit and rotate upper frame 12 with main frame 12 about a center journal relative to lower frame 20 and the crawler unit, as is conventional in the prior art. Such propelling and rotating machinery is housed in a cab structure 23 provided on main frame 12 which also houses other machinery and components of the shovel as later will be described.

The lower end of stiffleg 13 is bifurcated, providing a pair of feet which are pivotally connected to main frame 12 by means of a pair of foot pins thus permitting the stiffleg to be pivoted in a vertical plane. The outer, upper end of stiffleg 13 is provided with a head shaft 24 on which there is pivotally mounted various components including the dipper handle and hoist frame. Dipper handle 15 generally consists of a pair of transversely spaced, longitudinally disposed beams pivotally connected at the outer ends thereof to the side walls of the dipper, interconnected along the lengths thereof by bracing members, and pivotally connected at the upper ends thereof to head shaft 24.

Hoist frame 14 has substantially a triangular configuration and includes a base member 25 pivotally mounted on head shaft 24, a post member 26 being disposed substantially perpendicular to base member 25 and having the lower end thereof integrally connected to the front end of the base member, and a tension member 27 integrally interconnecting the upper end of post member 26 and the rear end of base member 25. In an alternate embodiment of the hoist frame in which the upper end of the dipper handle is pivotally connected to the hoist frame, the forward end of base member 25 is bifurcated, providing a pair of forwardly projecting arm portions to which the upper end of the dipper handle is pivotally connected. As illustrated in FIG. 1, a shaft 28 is provided at the rear end of base member 25 on which there is rotatably mounted a hoist sheave 29 for operatively connecting the hoist system to the hoist frame as later will be described. Also mounted on the base member substantially intermediate the head shaft and hoist sheave support shaft is a rigidly mounted connecting pin 30 for operatively connecting the crowd system to the hoist frame.

Dipper 16 is substantially of a conventional construction including a pair of transversely spaced side walls, a bottom wall, a plurality of digging teeth detachably mounted on the front lip of the bottom wall and a releasable door pivotally connected at its upper end to the side walls of the dipper. The dipper is adapted normally to pitch upwardly, the upward pitch being limited by a pitch stop 31 mounted on the upper side of the dipper handle. The pitch stop consists of a pair of beams mounted at an angle on the side beams of the dipper handle. The ends of the beams are engagable with abutment pads 32 rigidly mounted on the side walls of the dipper adjacent the pivotal connection of the dipper with hoist link 17.

Figure 2:
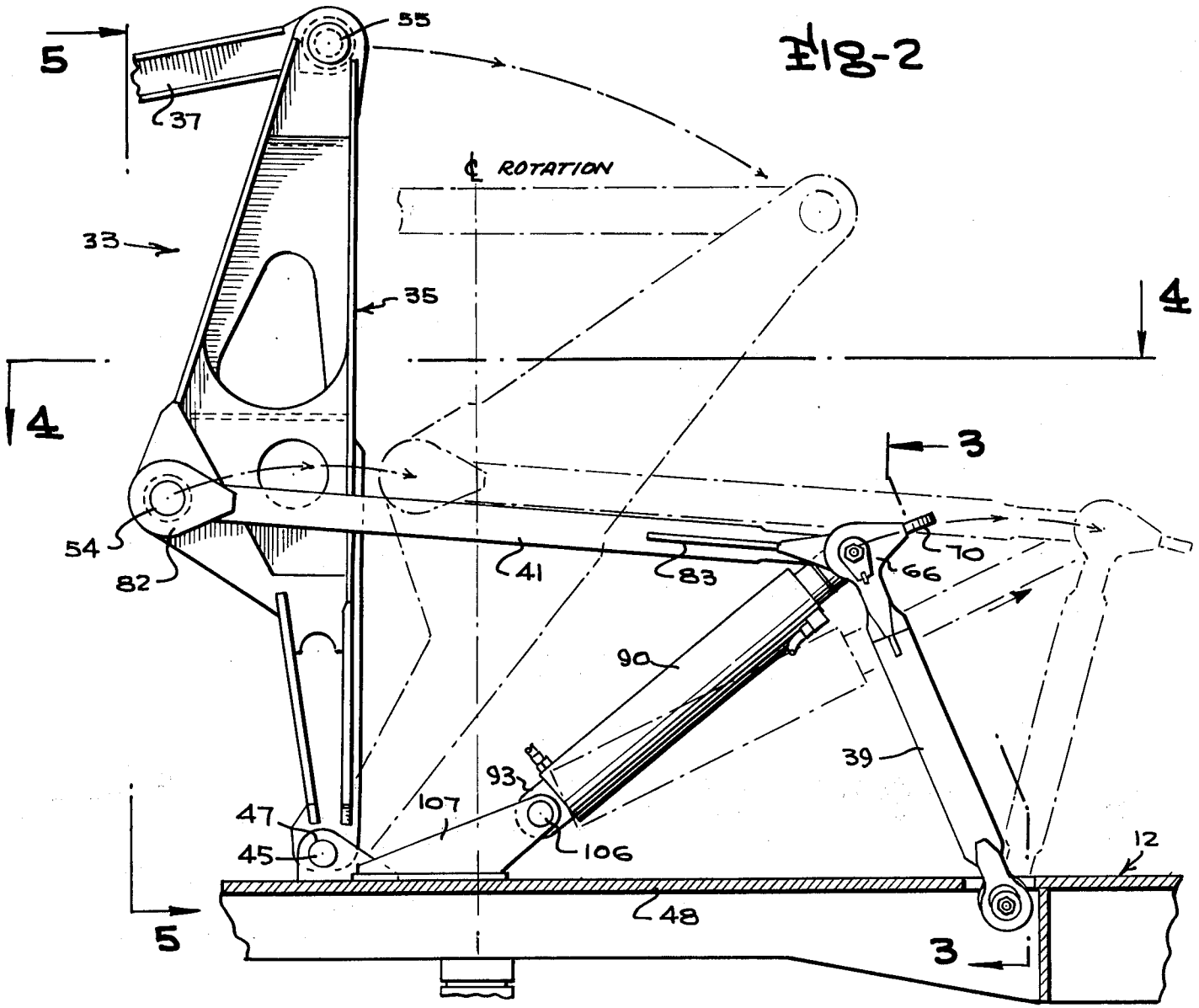
FIG. 2 is an enlarged side elevational view of a portion of the crowd system of the embodiment illustrated in FIG. 1.
Figure 4:
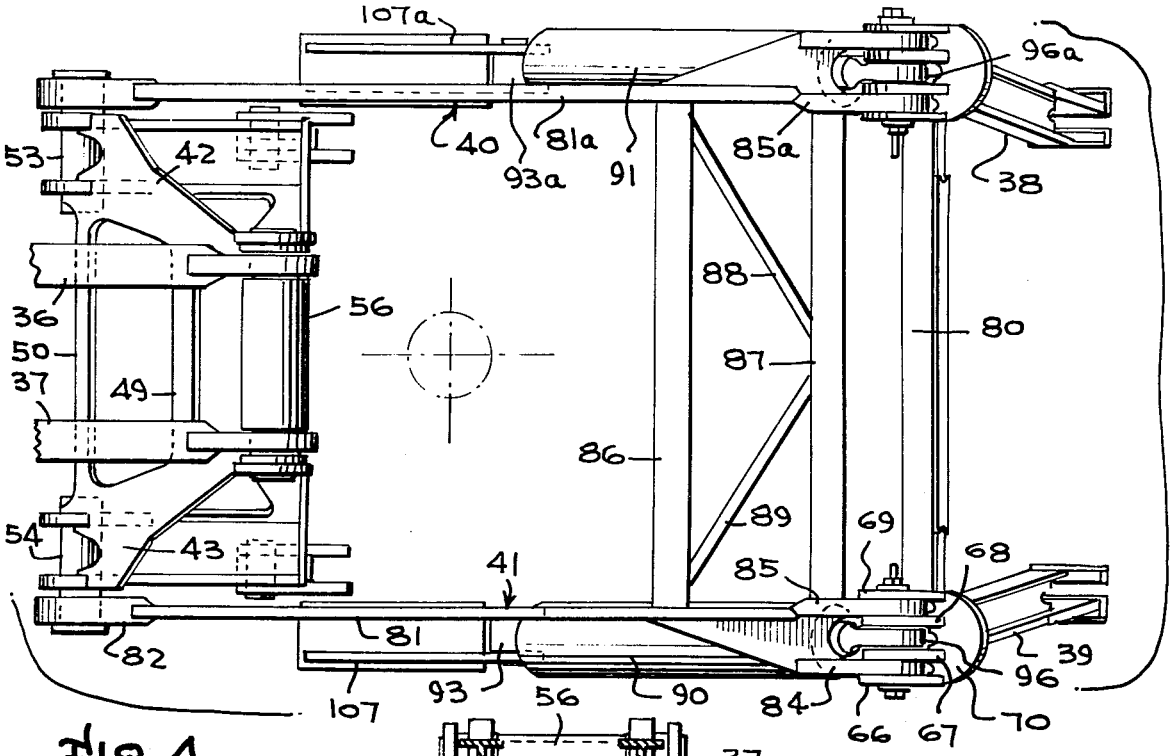
FIG. 4 is an enlarged plan view taken along line 4—4 in FIG. 2.
Figure 5:
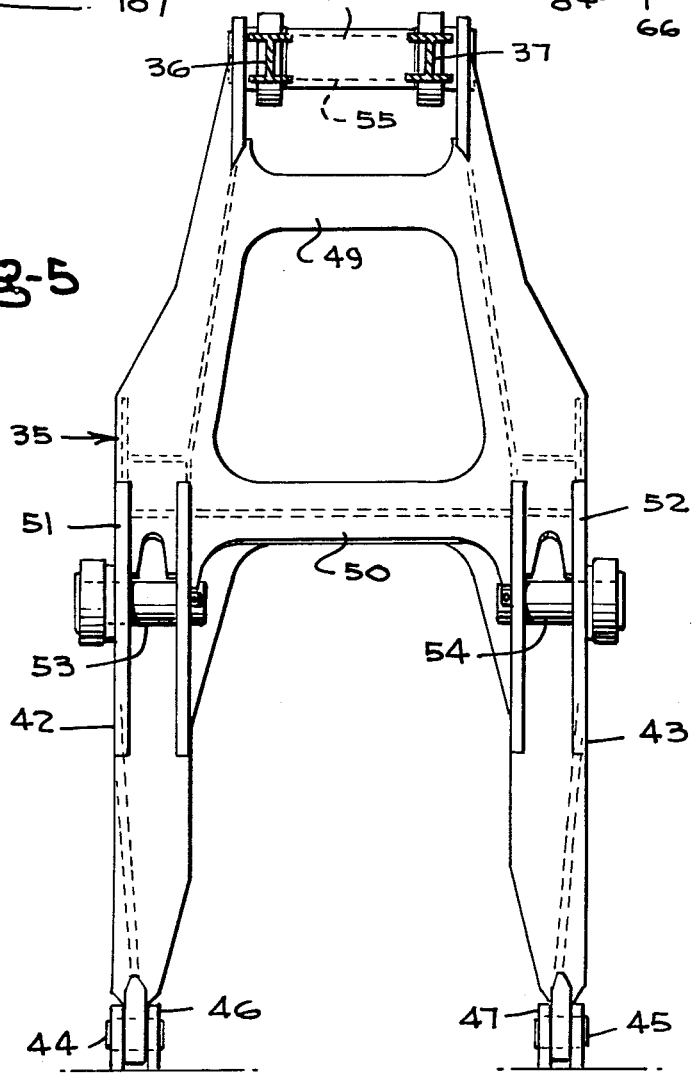
FIG. 5 is a cross-sectional view taken along line 5—5 in FIG. 2.

Crowd system 18 generally consists of a linkage 33 and a fluid actuating system 34. As best seen in FIGS. 2 and 4, linkage 33 includes a mast 35, a pair of connecting links 36 and 37, a pair of transversely spaced support links 38 and 39 and a pair of transversely spaced, crowd drive links 40 and 41. Mast 35 consists of a pair of transversely spaced, side sections 42 and 43 pivotally connected at their lower ends by means of pins 44 and 45 to mounting brackets 46 and 47 rigidly secured to the deck 48 of main frame 12, forwardly of the vertical centerline of rotation of the main frame, and a pair of cross-piece sections 49 and 50 interconnecting the side sections between the upper and lower ends thereof. Disposed on the front faces of side sections 42 and 43 and projecting forwardly therefrom are pairs of mounting brackets 51 and 52 in which there is mounted a pair of transversely disposed, axially aligned connecting pins 53 and 54. Also mounted in the upper ends of side sections 42 and 43 is a transversely disposed connecting pin 55 provided with a spacer sleeve 56 having end portions terminating inwardly relatively to the upper ends of side sections 42 and 43. As best shown in FIGS. 1 and 4, the rearwardly disposed ends of connecting links 36 and 37 are pivotally mounted on connecting pin 55 between spacer sleeve 56 and the upper ends of side sections 42 and 43, and the forwardly disposed ends thereof are pivotally connected to the laterally projecting portions of shaft 30 so that when mast 35 is pivoted in a substantially longitudinal, vertical plane about the axis of connecting pins 44 and 45, such motion will be transmitted through connecting links 36 and 37 to hoist frame 14 and correspondingly to the entire front end assembly including stiffleg 13, hoist frame 14, dipper handle 15, dipper 16 and connecting link 17.

Figure 3:
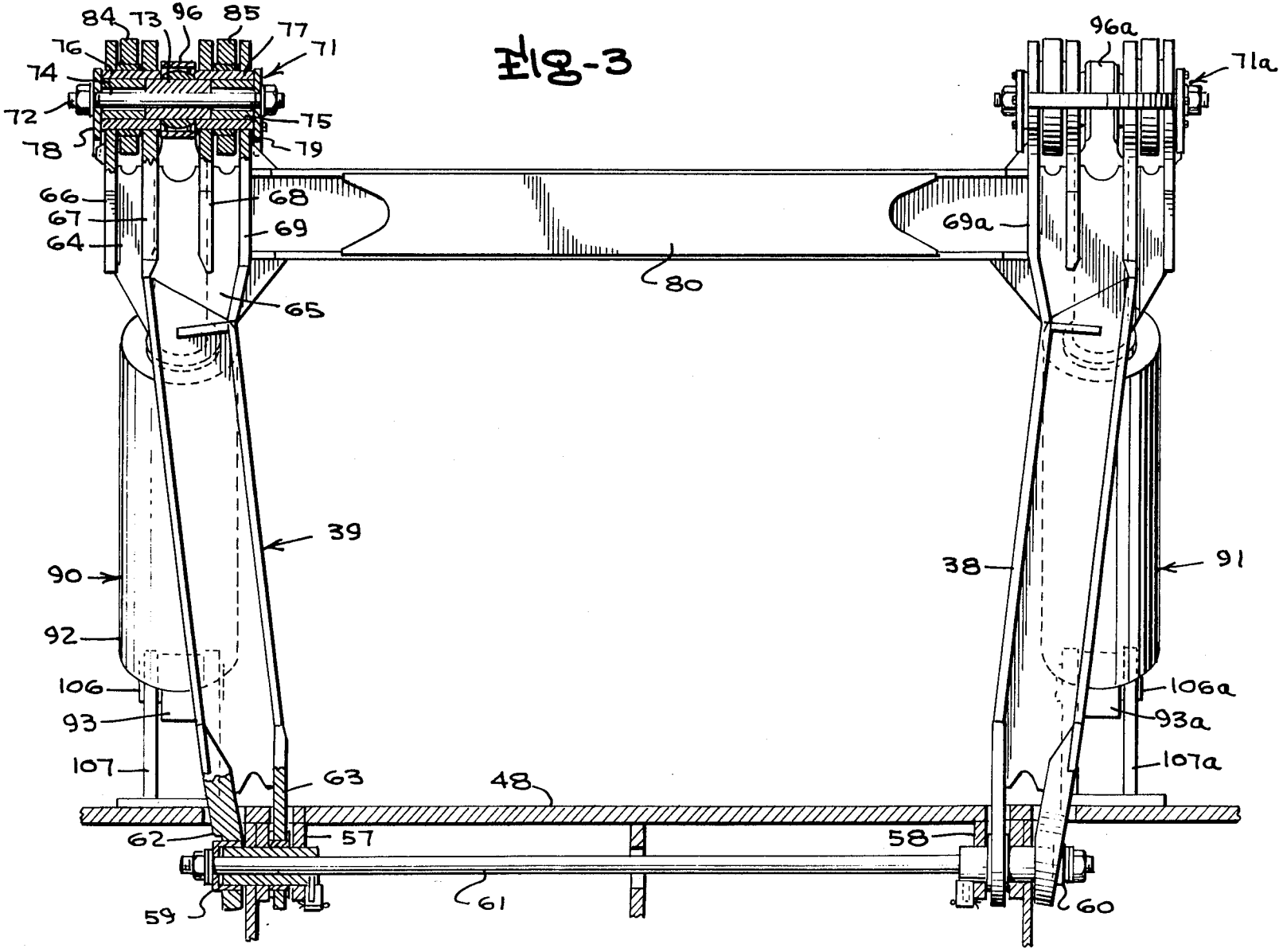
FIG. 3 is an enlarged cross-sectional view taken along line 3—3 in FIG. 2.

Referring to FIG. 3, the deck of the main frame is provided with transversely spaced, pairs of depending mounting plates 57 and 58, disposed rearwardly of roller circle 21. Mounted in such pairs of depending mounting plates is a pair of transversely disposed, axially aligned support shafts 59 and 60 interconnected by a rod 61 extending therethrough and provided with nuts threaded on the outer ends thereof.

Support link 39 is substantially similar to support link 38 in construction and function, and is provided at the lower end thereof with a pair of depending plates 62 and 63 which extend through openings in deck 48 and are pivotally mounted on suport shaft 59 to permit support link 39 to pivot in a longitudinally disposed plane about the axis of support shaft 59. The upper end of support link 39 is provided with a pair of transversely disposed plates 64 and 65 on which there is mounted longitudinally disposed, transversely spaced support plates 66 through 69, interconnected by a rearwardly projecting bridging plate 70. Support plates 66 through 69 are provided with aligned openings in which there is mounted a connecting pin assembly 71. The connecting pin assembly includes a retainer pin 72, an inner bushing 73 mounted on pin 72, a pair of spacers 74 and 75 also mounted on pin 73, a pair of outer bushings 76 and 77 mounted on spacers 74 and 75 and the outer ends of bushing 73, a pair of retainer plates 78 and 79 receiving the ends of retainer pin 72 therethrough and engaging the outer ends of bushings 76 and 77, and a pair of nuts threaded on the outer ends of pin 72 and engaging retainer plates 78 and 79. So that support links 38 and 39 will be pivoted about the axis of rod 61, the upper ends thereof are interconnected by a cross-piece member 80 rigidly secured at the ends thereof to plate 69 of link 39 and plate **69*a* of link 38**.

As best illustrated in FIG. 4, crowd drive links 40 and 41 are pivotally connected at the forwardly disposed ends thereof to connecting pins 53 and 54 and are pivotally connected at the rearwardly disposed ends thereof to connecting pin assemblies 71 and **71*a*. Crowd drive link 41 is similar to crowd drive link 40 in construction and function, and includes an elongated member 81 provided with a fixture 82 on the forwardly disposed end thereof mounted on the outer end of connecting pin 52, and a substantially horizontal support plate 83 disposed at the rearward end thereof. Rigidly secured to support plate 83 is a pair of transversely spaced, rearwardly projecting mounting plates 84 and 85 which are received between plates 66 and 67 and 68 and 69, respectively, and are mounted on outer bushings 76 and 77 of connecting pin assembly 71. Links 40 and 41 also are caused to move longitudinally as a unit by means of a cross-piece member 86 rigidly secured at the ends thereof to members 81 and 81*a*, a cross-piece member 87 rigidly connected at the ends thereof to mounting plates 85 and 85*a* and a pair of braces 88 and 89**.

Figure 6:
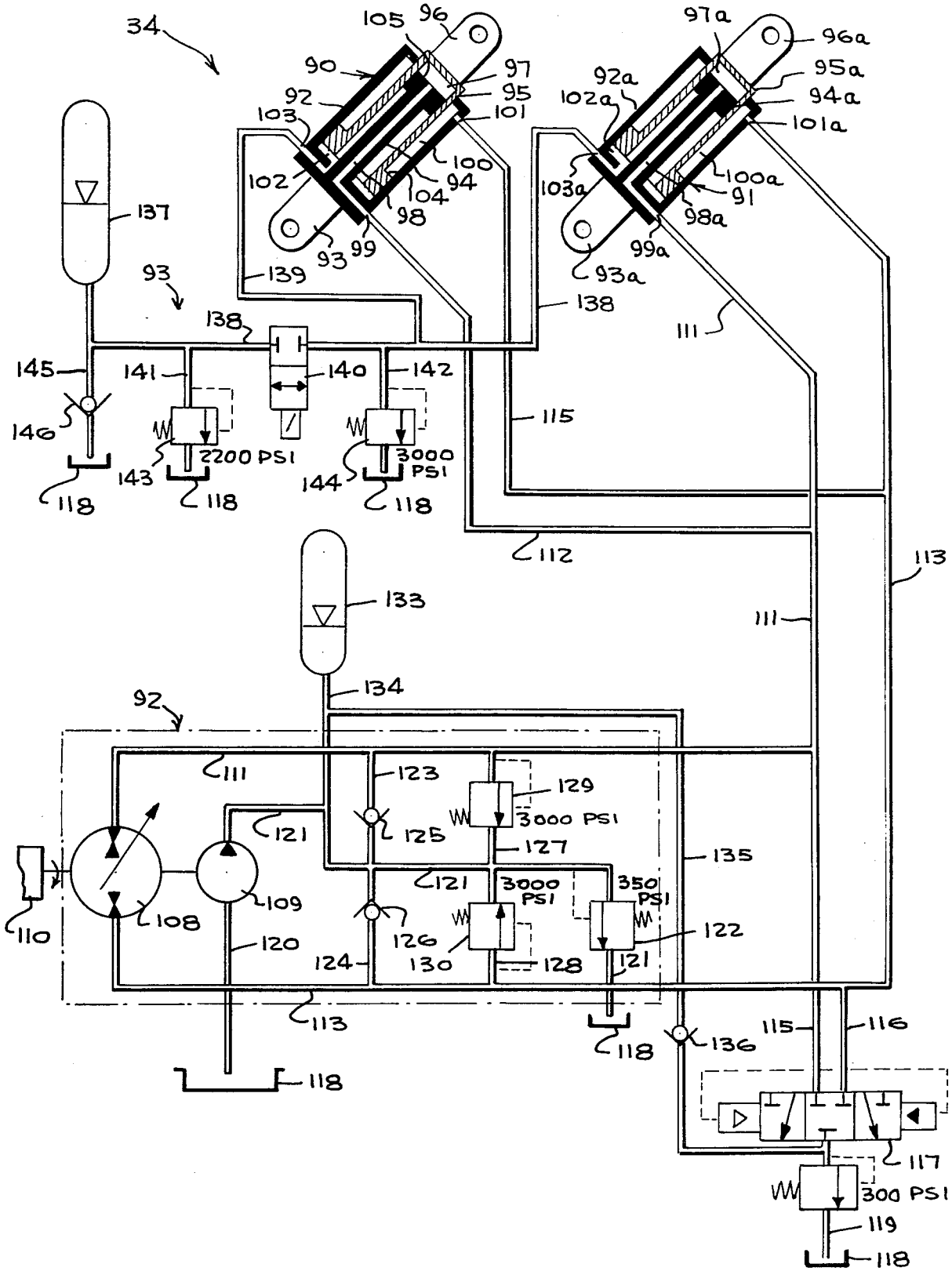
FIG. 6 is a schematic-diagrammatic view of the fluid actuating system comprising a portion of the crowd system utilized in the embodiment.

Fluid actuating system 34 generally consists of a pair of working piston and cylinder assemblies 90 and 91 operatively interconnecting the main frame and linkage 33, a fluid supply system 92 operatively connected to piston and cylinder assemblies 90 and 91, and an energy regeneration system 93 also operatively connected to piston and cylinder assemblies 90 and 91. Referring to FIG. 6, piston and cylinder assembly 90 includes a cylinder 92 provided with a connecting bracket 93 at a lower end thereof and a fixed piston 94 disposed within the cylinder, and a moveable piston 95 mounted on fixed piston 94 within cylinder 92, having a connecting bracket 94 on the upper end thereof. As illustrated in the drawing, cylinder 92, fixed piston 94 and movable piston 95 define a variable volume chamber 97 communicating through a passageway 98 in fixed piston 94 with a port 99, a variable volume chamber 100 communicating with a port 101 and a variable volume chamber 102 communicating with a port 103. The assembly as described is designed so that the annular surface 104 is substantially equal to the area 105 of fixed piston 94. Piston and cylinder assembly 91 is similar to assembly 90 in construction and operation, providing a cylinder **92*a* having a connecting bracket 93*a* and a fixed piston 94*a*, and a movable piston 95*a* having a connecting bracket 96*a*, defining a variable volume chamber 97*a* communicating through a passageway 98*a* with a port 99*a*, a variable volume chamber 100*a* communicating with a port 101*a* and a variable volume chamber 102*a* communicating with a port 103*a***.

As best illustrated in FIGS. 2 through 4, connecting brackets 93 and **93*a* are pivotally connected to connecting pins 106 and 106*a* mounted on support brackets 107 and 107*a*. Connecting brackets 96 and 96*a* are pivotally connected to bushings 73 and 73*a*** of connecting pin assemblies 71 and 71*a*. Support brackets 107 and 107*a* are secured to the deck of the main frame longitudinally, substantially at the centerline of rotation of the main frame so that forces exerted along the centerlines of piston and cylinder assemblies 90 and 91 will be imposed on the main frame longitudinally at points adjacent the centerline of rotation thus minimizing bending moments in the main frame.

Fluid supply system 92 includes a bi-directional, variable displacement main pump 18 and a uni-directional, replenishing pump 109 driven by a prime mover 110, preferably a motor-generator set. One of the ports of main pump 108 is connected to ports 99 nd 99*a* of piston and cylinder assemblies 90 and 91 by means of fluid supply lines 111 and 112. Similarly, the other port of main pump 108 is connected to ports 101 and 101*a* of piston and cylinder assemblies 90 and 91 by means of fluid supply lines 113 and 114. Accordingly, it will be seen that by operating main pump 108 in either direction, fluid under pressure may be supplied either to chambers 97 and 97*a* to extend movable pistons 105 and 105*a*, or to chambers 100 and 100*a* to retract such pistons.

Hot oil may be removed from fluid supply lines 111 and 113 by means of fluid lines 115 and 116 connecting fluid supply lines 111 and 113 with a shuttle relief valve 117 which is connected with a tank reservoir 118 by means of a discharge line 119. Shuttle relief valve 117 is responsive to pressures in fluid supply lines 111 and 113, causing it to shift to remove oil selectively from the fluid supply lines.

Replenishing pump 109 is utilized primarily to assure a full supply of oil in supply lines 111 and 113 to prevent cavitation. The inlet port of pump 109 is connected to fluid reservoir 118 by means of a fluid line 120, and the outlet port thereof is connected to the fluid reservoir by means of a fluid line 121. A predetermined pressure is maintained in fluid line 121 by means of a relief valve 122. Fluid line 121 also is connected to fluid supply lines 111 and 113 by means of branch lines 123 and 124 provided with check valves 125 and 126, respectively. In addition, fluid line 121 is connected to fluid supply lines 111 and 113 by means of lines 127 and 128 provided with relief valves 129 and 130 which are responsive to line pressure in fluid supply lines 111 and 113.

In operation, it will be seen that when main pump 108 and replenishing pump 109 are operating and a predetermined pressure in line 121 is not exceeded as determined by relief valve 122, fluid under pressure will be caused to flow through either check valve 125 or 126 in either of branch lines 123 and 124, respectively, to replenish fluid in either of fluid supply lines 111 and 113, whenever the pressure the 111 or 113 line falls below a second predetermined pressure which is lower than the aforementioned pressure sufficient to open valve 122. Also, it will be seen that when a predetermined pressure is exceeded in either of fluid supply lines 111 and 113 as determined by relief valves 129 and 130, fluid will be caused to flow through branch lines 127 and 128 including relief valves 129 and 130, respectively and fluid line 121 including relief valve 122, to reservoir 118. Instantaneous replenishing demands due to sudden increases in load pressure and compression of the working fluid which are much larger than replenishing pump 109 can supply, is provided for by at least one hydro-pneumatic accumulator 133 communicating with fluid line 121 through a line 134. In addition, since a sudden release of load results in a rapid decompression of fluid in the fluid supply lines and results in a large instantaneous flow rate through shuttle relief valve 117, a fluid line 135 provided with a check valve 136, interconnecting discharge line 119 and fluid line 121 through accumulator supply line 134, is provided so that a portion of the energy of such fluid is conserved in accumulator 133 for subsequent replenishing requirements.

During the various phases of the digging cycle as will later be described, oil removed from fluid supply lines 111 and 113 through shuttle relief valve 117 and oil lost through internal leakage is replenished by replenishing pump 109. In addition, instantaneous replenishing demands are satisfied by means of accumulator 133 which may be charged by replenishing pump 109 or a large instantaneous flow rate through shuttle relief valve 117 caused by rapid decompression of fluid in the system resulting in a sudden release of load.

Energy regeneration system 93 includes a hydro-pneumatic accumulator 137 communicating with variable volume chambers 102 and 102*a* by means of fluid lines 138 and 139 which interconnect accumulator 137 and ports 103 and 103*a* of piston and cylinder assemblies 90 and 91. Fluid line 138 includes a solenoid operated, cutoff valve 140 and is connected on opposite lines of cutoff valve 140 to reservoir 118 through branch lines 141 and 142 provided with relief valves and 143 and 144. In addition, accumulator 137 is communicable with reservoir 118 through a line 145 provided with a check valve 146.

It will be appreciated that the energy regeneration system functions in a manner whereby when cutoff valve 140 is opened and movable pistons 95 and 95*a* are caused to retract, fluid ejected from chambers 102 and 102*a* will be caused to flow through lines 138 and 139 to charge accumulator 137. Pressure supplied by accumulator 137 functions to counteract the forces causing the movable cylinders to retract thus reducing the energy requirements of prime mover 110 in subsequently operating to extend the movable cylinders. It further will be noted that movable cylinders 95 and 95*a* can be locked in position merely by closing valve 140 thus trapping fluid in chambers 102 and 102*a* which prevents the movable pistons from either extending or retracting. When valve 140 is closed, excessive pressures in lines 138 and 139 between valve 140 and piston and cylinder assemblies 90 and 91 may be relieved by means of relief valve 144, and excessive pressures in line 138 between accumulator 137 and valve 140 may be relieved by means of relief valve 143.

Hoist system 19 is substantially conventional in design and generally includes a hoist drum and drive (not shown) mounted on the main frame within the cab structure, a sheave 147, hoist sheave 29 and a hoist line 148 operatively interconnecting the hoist drum and sheaves 147 and 29. As in the conventional manner, whenever the hoist line is either played out or taken in, hoist frame 14 and correspondingly dipper handle 15, dipper 16 and hoist link 17 will be caused to pivot about the head shaft mounted on the upper end of the stiffleg.

During the crowding phase of the digging cycle of the shovel, the pitch of dipper 16 can be maintained fixed relative to the main frame of the shovel by means of a pitch control system consisting of a pair of pantograph linkages 149 mounted on opposite sides of the stiffleg and dipper handle, a pair of sheaves 150 mounted on the foot pins connecting the lower end of the stiffleg to the maingframe of the shovel, and a pair of fluid actuated piston and cylinder assemblies 151 having the cylinders thereof rigidly secured to the main frame. The pantograph linkages 149 are substantially identical in construction and operation. As illustrated in FIG. 1 and described in greater detail in U.S. Pat. Nos. 3,501,034 and 3,648,863, each linkage 149 consists of a pitch bell crank 152 pivotally mounted on the outer end of head shaft 24, a pitch link 153 connected at one end thereof to the forwardly disposed end of the pitch bell crank, reeved about sheave 150 and connected at the opposite end to the piston portion of cylinder assembly 151, and a pitch link 154 connected at one end thereof to a rearwardly disposed point on the pitch bell crank and connected at the opposite end thereof to a side wall of the dipper.

The dipper portion control system as described operates in a manner whereby whenever the pistons of cylinder assemblies 151 are permitted to float freely, the pitch of the dipper will be permitted to change with respect to the forces imposed by its own weight or contact of the dipper with the ground or material being excavated. However, upon locking the pistons of cylinder assemblies 151, the pantograph linkages will cause the pitch of the dipper to become fixed until such pistons are released and again permitted to float freely.

In the operation of the embodiment as described, the front end assembly of the shovel is positioned at the beginning of the digging cycle by operating the crowd system to pivot the stiffleg to its upward, rearmost position, operating the hoist system downwardly and rearwardly to a position adjacent the stiffleg, and rendering inoperative the holding means of the dipper pitch control system so that the dipper will being freely and assume a position designated by the phantom lines in FIG. 1. In retracting the front end assembly, the prime mover 110 is operated to supply fluid under pressure to chambers 97 and **97*a* thus causing movable cylinders 95 and 95*a* to extend. Simultaneously, assuming valve 140 is open and accumulator 137 is charged, a force will be exerted on pistons 95 and 95*a*, biasing the movable pistons toward the extended position thus reducing the amount of energy input required by prime mover 110. If, on the other hand, accumulator 137 is not charged, the reduced pressure in line 138 will open valve 146 and permit fluid to flow into fluid line 138**.

With the front end assembly positioned as indicated by the phantom lines in FIG. 1, the digging cycle of the shovel may commence by reversing the direction of prime mover 110, thus causing fluid under pressure to be supplied by main pump 108 through fluid supply lines 113 and 114 to chambers 100 and **100*a* of cylinder assemblies 90 and 91. Such action causes movable pistons 95 and 95*a* to retract, correspondingly causing the stiffleg to pivot downwardly under the combined forces of the weight of the front end assembly and the force exerted by the crowd system. Simultaneously, the hoist mechanism is operated to take in hoist line and permit the dipper handle to pivot forwardly, away from the stiffleg to provide a knee-type action characteristic of the type of shovel described. As such knee-action progresses, the dipper will be caused to pivot so that the bottom wall thereof will be seated on the ground in a horizontal position. The operator then actuates certain controls to lock the pistons of the cylinder assemblies 151** whereupon as the knee-action of the front end assembly continues, the dipper pitch control system will cause the pitch of the dipper to remain fixed and the dipper to be crowded into the material being excavated, along a horizontal line of travel, to a maximum extended position.

During such crowding action, fluid is forced out of chambers 102 and **102*a* of cylinder assemblies 90 and 91*a* and functions to load accumulator 137. At the end of the crowding phase of the digging cycle when the dipper has made its maximum penetration into the material being excavated, the operator actuates appropriate controls to reverse the direction of prime mover 110 thus again causing pump 108 to supply fluid under pressure through fluid supply lines 111 and 112 to chambers 97 and 97*a* of cylinder assemblies 90 and 91 to extend movable pistons 97 and 97*a* and correspondingly to retract the front end assembly. Simultaneously, the operator actuates appropriate controls to release the pistons of cylinder assemblies 151 thus permitting the dipper to pitch upwardly until the pads 32 of the dipper engage pitch stop 31. As such action takes place, the hoist line continues to be taken in thus causing the dipper to be hoisted until it reaches a dump position. In such position, the dumping door of the dipper will be disposed substantially horizontal and the dipper will be filled with a maximum load of material ready to be dumped. The rotating mechanisms on the shovel may then be operated to position the dipper over the location where the material is to be dumped, and the door may be unlatched to discharge the material. From such point on, the hoist mechanism is operated to pay out hoist line and the propelling and rotating machinery on the shovel are operated to return the front end assembly into position to begin the next digging cycle. Simultaneously, as the front end assembly is being retracted, the pressure exerted in chambers 102 and 102*a* of cylinder assemblies 90 and 91 by accumulator 137** assists in retracting the front end assembly.

Referring to FIG. 2, it will be appreciated that when movable pistons 95 and **95*a* are extended, support links 38 and 39 will be caused to pivot rearwardly to the position as illustrated in phantom lines. Correspondingly, such motion will be transmitted through crowd drive links 40 and 41 to mast 35 causing the mast also to pivot rearwardly to a position as illustrated in phantom lines. The rearward pivotal movement of the mast is transmitted through connecting links 36 and 37 to hoist frame 14, correspondingly causing stiffleg 13 to pivot rearwardly, thus retracting the entire front end assembly. When movable cylinders 95 and 95*a* are then retracted, the components of linkage 33 are caused to return to the positions as illustrated solid lines in FIG. 2, providing a force combined with the force of the weight of the entire front end assembly to crowd the dipper. As best illustrated in FIGS. 1 and 2, the components of linkage 33 are mounted both forwardly and rearwardly of the center line of rotation of the main frame to more uniformly distribute the load of the weight of the linkage on the main frame. In addition, mounting brackets 107 and 107*a* supporting the lower ends of working piston and cylinder assemblies 90 and 91** are positioned above or as adjacent thereto as permitted by the arrangement of components on the deck of the main frame so that forces exerted along the axes of such assemblies will be imposed on or adjacent the roller circle thus minimizing bending moments in the main frame.

In the embodiment described, piston and cylinder assemblies provided with three chambers are utilized for extending and retracting the front end assembly and for loading the energy storing means. As an alternative to such an arrangement, two or more conventional piston and cylinder assemblies, each having two chambers, may be utilized wherein a chamber of one of such assemblies would be connected to the energy storing means, i.e., an accumulator, and the other chambers of the assemblies would be connected to the working pump for extending and retracting the pistons thereof. In this regard, it further is contemplated that in such an arrangement, the conventional cylinder assemblies may interconnect different components of the shovel having relative movement, and different combinations of three chamber and two chamber cylinder assemblies may be used interconnecting different components of the shovel having relative movements. It also is contemplated that as an alternative to the variable displacement pump as described in connection with the aforementioned embodiment, a fixed displacement pump provided with a four-way directional control valve may be utilized. The use of such a fixed displacement pump, however, would result in some reduction in controlment and operating efficiency, the loss of ability to regenerate energy into the prime mover.

From the embodiment as described, it will be appreciated that the energy input of the shovel is reduced without a corresponding reduction in work output, as a result of the conservation of the potential energy of the front end system. Such conservation of energy is accomplished by converting the potential energy of the front end system to stored energy in the form of compressed gas in the hydro-pneumatic accumulators. Although the embodiment described discloses an arrangement whereby working piston and cylinder assemblies of the crowd system also function to load the energy storing means during the crowding phase of the digging cycle of the machine, and the energy regeneration system functions as a hydro-pneumatic spring biasing the front end assembly in a raised or retracted position, it is to be understood that the invention contemplates the recovery and storage of potential energy of one or a combination of components of the front end assembly and utilizing such energy to bias one or more components of the front end assembly either automatically or selectively toward a predetermined movement. The various arrangements contemplated for effecting the recovery and utilization of the potential energy of the front end assembly, would include various combinations of working piston and cylinder assemblies interconnecting the main frame and a component of the front end assembly or interconnecting different components of the front end assembly for effecting predetermined movements of the components, accumulators for storing energy converted from the potential energy of the front end assembly which are capable of either automatically or selectively exerting a force on one or more components of the front end assembly to bias them toward predetermined movements, and piston and cylinder assemblies actuated by predetermined movements of components of the front end system for converting the potential energy thereof to stored energy in the accumulators. As an example, the potential energy of the front end assembly in an elevated or retracted position can be recovered and stored during the crowding phase of a digging cycle and then applied to the dipper handle to assist in hoisting the dipper. Although such other types of arrangements for conserving energy are available, the arrangement as provided in the aforementioned embodiment is deemed most practical.

From the foregoing detailed description, it will be evident that there are a number of changes, adaptations and modifications of the present invention which come within the province of those skilled in the art. However, it is intended that all such variations not departing from the spirit of the invention be considered as within the scope thereof and is limited solely by the appended claims.

We claim:

1. A power shovel comprising a body; a front end assembly mounted on said body including a stiffleg pivotally connected to said body, a dipper handle operatively connected to said stiffleg and a dipper operatively connected to said dipper handle; means mounted on said body and operatively connected to said front end assembly for hoisting said dipper; and means mounted on said body and operatively connected to said front end assembly for crowding said dipper; said crowding means including at least one fluid actuated, working piston and cylinder assembly operatively interconnecting said body of said front end assembly whereupon selectively supplying fluid under pressure to opposite ends of said cylinder, said front end assembly correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing the charged condition a force applicable to a component of said front end assembly for biasing said component toward a predetermined movement wherein said crowd system includes a mast pivotally connected at a lower end thereof to said body and a connecting link pivotally connected at opposite ends thereof to said mast and said front end assembly; and wherein said working piston and cylinder assembly operatively interconnects said body and said mast.

2. A power shovel comprising a body; a front end assembly mounted on said body including a stiffleg pivotally connected to said body, a dipper handle operatively connected to said stiffleg and a dipper operatively connected to said dipper handle; means mounted on said body and operatively connected to said front end assembly for hoisting said dipper; and means mounted on said body and operatively connected to said front end assembly for crowding said dipper; said crowding means including at least one fluid actuated, working piston and cylinder assembly operatively interconnecting said body of said front end assembly whereupon selectively supplying fluid under pressure to opposite ends of said cylinder, said front end assembly correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing the charged condition a force applicable to a component of said front end assembly for biasing said component toward a predetermined movement wherein said crowd system includes a mast pivotally connected at a lower end thereof to said body, a support link pivotally connected at a lower end thereof to said body and a crowd drive link pivotally connected at opposite ends thereof to said mast and said support link;

and wherein said working piston and cylinder assembly is pivotally connected at one end thereof to said body and pivotally connected at the opposite end thereof to one of said support link, crowd drive link and the pivotal connection between said support link and said crowd drive link.

3. A power shovel according to claim 2 wherein the pivotal connection of said mast to said body is disposed longitudinally, forwardly of a vertical center line of said body, the pivotal connection of said support link with said body is disposed longitudinally, rearwardly of said vertical centerline and the pivotal connection between said working piston and cylinder assembly to said body is disposed longitudinally, substantially at said vertical center line.

4. A power shovel comprising a body; a front end assembly mounted on said body including a stiffleg pivotally connected to said body, a dipper handle operatively connected to said stiffleg and a dipper operatively connected to said dipper handle; means mounted on said body and operatively connected to said front end assembly for hoisting said dipper; and means mounted on said body and operatively connected to said front end assembly for crowding said dipper; said crowding means including at least one fluid actuated, working piston and cylinder assembly operatively interconnecting said body of said front end assembly whereupon selectively supplying fluid under pressure to opposite ends of said cylinder, said front end assembly correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing the charged condition a force applicable to a component of said front end assembly for biasing said component toward a predetermined movement, said power shovel including a second energy storing means and means responsive to a sudden decompression of fluid in said working cylinder and piston assembly for charging said second energy storing means.

5. A power shovel according to claim 4 including means for applying a force produced by said second energy storing means to a selected working component responsive to a predetermined condition.

6. A power shovel comprising a body; a front end assembly mounted on said body including a stiffleg pivotally connected to said body, a dipper handle operatively connected to said stiffleg and a dipper operatively connected to said dipper handle; means mounted on said body and operatively connected to said front end assembly for hoisting said dipper; and means mounted on said body said operatively connected to said front end assembly for crowding said dipper; said crowding means including at least one fluid actuated, working piston and cylinder assembly operatively interconnecting said body of said front end assembly whereupon selectively supplying fluid under pressure to opposite ends of said cylinder, said front end assembly correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing the charged condition a force applicable to a component of said front end assembly for biasing said component toward a predetermined movement wherein said crowd system includes a mast pivotally connected at a lower end thereof to said body longitudinally, forwardly of a vertical center line of said body, a pair of transversely spaced support links pivotally connected a lower ends thereof to said body longitudinally, rearwardly of said vertical center line, a pair of crowd drive links pivotally connected at opposite ends thereof to said mast and said support links; and a pair of transversely spaced, fluid actuated, working piston and cylinder assemblies pivotally connected at lower ends thereof to said body longitudinally, substantially at said vertical center line and pivotally connected at the opposite ends thereof to the pivotal connection between said support links and said crowd drive links.

7. A power shovel comprising a body; a front assembly mounted on said body including a stiffleg pivotally connected to said body, a dipper handle operatively connected to said stiffleg and a dipper operatively connected to said dipper handle; means mounted on said body and operatively connected to said front end assembly for hoisting said dipper; and means mounted on said body and operatively connected to said front end assembly for crowding said dipper; said crowding means including at least one fluid actuated, working piston and cylinder assembly operatively interconnecting said body of said front end assembly whereupon selectively supplying fluid under pressure to opposite ends of said cylinder, said front end assembly correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing the charged condition a force applicable to a component of said front end assembly for biasing said component toward a predetermined movement wherein said means for selectively supply fluid under pressure to opposite ends of the cylinder of said working piston and cylinder assembly comprises a bi-directional, variable displacement pump and fluid supply lines operatively interconnecting said pump and opposite ends of said cylinder to provide a closed fluid circuit.

8. A power shovel according to claim 7 including means for limiting the fluid pressure in said fluid supply lines to a predetermined pressure.

9. A power shovel according to claim 8 wherein said fluid pressure limiting means comprise relief valves.

10. A power shovel according to claim 8 including means for replenishing fluid in said fluid supply lines

11. A power shovel according to claim 10 wherein said replenishing means includes an auxiliary pump having an input communicating with a fluid reservoir and an output communicable with either or both of said fluid supply lines responsive to a predetermined pressure in said fluid supply lines.

12. A power shovel according to claim 11 wherein said replenishing means includes an accumulator communicating with the output of said auxiliary pump and communicable with said fluid supply lines responsive to said predetermined pressure.

13. A power shovel according to claim 2 including means for removing fluid from said fluid supply lines under predetermined conditions.

14. A power shovel according to claim 13 wherein said means for removing fluid from said fluid supply lines includes a valve adapted to open in response to a predetermined pressure in said fluid supply lines for selectively communicating a fluid supply line at said predetermined pressure with a fluid reservoir.

15. A power shovel according to claim 6 including a second energy storing means and means responsive to a sudden decompression of fluid in said working piston and cylinder assemblies for charging said second energy storing means.

16. A power shovel according to claim 15 including means for communicating said second energy storage means selectively to opposite ends of the cylinders of said piston and cylinder assemblies responsive to predetermined conditions.

17. A power shovel comprising a body; a front end assembly mounted on said body including a stiffleg pivotally connected to said body, a dipper handle operatively connected to said stiffleg and a dipper operatively connected to said dipper handle; means mounted on said body and operatively connected to said front end assembly for hoisting said dipper; and means mounted on said body and operatively connected to said front end assembly for crowding said dipper; said crowding means including at least one fluid actuated, working piston and cylinder assembly operatively interconnecting said body of said front end assembly whereupon selectively supplying fluid under pressure to opposite ends of said cylinder, said front end assembly correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing the charged condition a force applicable to a component of said front end assembly for biasing said component toward a predetermined movement wherein said charging means includes means operatively connected to said actuating component of said front end assembly and a closed hydraulic circuit for transmitting a force from said connecting means to said energy storing means, said closed hydraulic circuit includes a cutoff valve disposed between said connecting means and said energy storing means, and said power shovel includes a first relief valve connected to said closed hydraulic circuit between said connecting means and said cutoff valve, adapted to open responsive to a predetermined pressure in said closed hydraulic circuit between said connecting means and said cutoff valve when said cutoff valve is closed, and a second relief valve connected to said closed hydraulic circuit between said energy storing means and said cutoff valve, adapted to open responsive to a predetermined pressure in said closed hydraulic circuit between said energy storing means and said cutoff valve, when said cutoff valve is closed.

18. A power shovel comprising a body; a front end assembly mounted on said body including a stiffleg pivotally connected to said body, a dipper handle operatively connected to said stiffleg and a dipper operatively connected to said dipper handle; means mounted on said body and operatively connected to said front end assembly for hoisting said dipper; and means mounted on said body and operatively connected to said front end assembly for crowding said dipper; said crowding means including at least one fluid actuated, working piston and cylinder assembly operatively interconnecting said body of said front end assembly whereupon selectively supplying fluid under pressure to opposite ends of said cylinder, said front end assembly correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing the charged condition a force applicable to a component of said front end assembly for biasing said component toward a predetermined movement wherein said fluid actuated, working piston and cylinder assembly includes a cylinder, a fixed piston mounted in said cylinder and a movable piston mounted on said fixed piston within said cylinder providing a first variable volume chamber defined by said fixed and movable pistons, a second variable volume chamber defined by said movable piston and said cylinder and a third variable volume chamber defined by said movable and fixed pistons and said cylinder; said means for selectively supplying fluid under pressure to opposite ends of said cylinder communicates with said first and second variable volume chambers; and said charging means includes said movable piston, operatively connected to said actuating component of said front end assembly and a closed hydraulic circuit intercommunicating said third chamber and said energy storing means.

19. A power shovel according to claim 18 wherein said closed hydraulic circuit includes a cutoff valve.

20. A power shovel according to claim 19 including means for limiting the pressure in said closed hydraulic circuit between said cutoff valve and said third variable volume chamber to a predetermined pressure when said cutoff valve is closed, and means for limiting the pressure in said closed hydraulic circuit between said energy storing means and said cutoff valve to a predetermined pressure when said cutoff valve is closed.

21. A power shovel according to claim 18 wherein said energy storing means comprises a hydro-pneumatic accumulator.

22. A power shovel according to claim 18 including a second energy storing means and means responsive to a sudden decompression of fluid in said working piston and cylinder assembly for charging said second energy storing means.

23. A power shovel according to claim 22 including means for communicating said second energy storing means selectively with one said first and second variable volume chambers of said working piston and cylinder assembly responsive to predetermined conditions.

24. A power shovel according to claim 23 wherein said second energy storing means comprises a hydro-pneumatic accumulator.

25. A crowd system for a power shovel having a body; a front end assembly mounted on said body including a stiffleg pivotally connected to said body, a dipper handle operatively connected to said stiffleg and a dipper operatively connected to said dipper handle; and means mounted on said body and operatively connected to said front end assembly for hoisting said dipper, comprising at least one fluid actuated, working piston and cylinder assembly operatively interconnecting said body and said front end assembly whereupon selectively supplying fluid under pressure to opposite ends of the cylinder of said assembly, said front end system correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing in the charged condition a force applicable to a component of said front end assembly for biasing said component toward a predetermined movement, said crowd system including a mast pivotally connected at a lower end thereof to said body and a connecting link pivotally connected at opposite ends thereof to said mast and said front end assembly; and wherein said working piston and cylinder assembly operatively interconnects said body and said mast.

26. A crowd system for a power shovel having a body; a front end assembly mounted on said body including a stiffleg pivotally connected to said body, a dipper handle operatively connected to said stiffleg and a dipper operatively connected to said dipper handle; and means mounted on said body and operatively connected to said front end assembly for hoisting said dipper, comprising at least one fluid actuated, working piston and cylinder assembly operatively interconnecting said body and said front end assembly whereupon selectively supplying fluid under pressure to opposite ends of the cylinder of said assembly, said first end system correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing in the charged condition a force applicable to a component of said front end assembly for biasing said component toward a predetermined movement, said crowd system including a mast pivotally connected at a lower end thereof to said body, a support link pivotally connected at a lower end thereof to said body and a crowd drive link pivotally connected at opposite ends thereof to said mast and said support link; and wherein said working piston and cylinder assembly is pivotally connected at one end thereof to said body and pivotally connected at the opposite end thereof to one of said support link, crowd drive link and the pivotal connection between said support link and said crowd drive link.

27. A crowd drive according to claim 26 wherein the pivotal connection of said mast to said body is disposed longitudinally, forwardly of a vertical center line of said body, the pivotal connection of said support link with said body is disposed longitudinally, rearwardly of said vertical center line and the pivotal connection between said working piston and cylinder assembly to said body is disposed longitudinally, substantially at said vertical center line.

28. A crowd system for a power shovel having a body; a front end assembly mounted on said body including a stiffleg pivotally connected to said body, a dipper handle operatively connected to said stiffleg and a dipper operatively connected to said dipper handle; and means mounted on said body and operatively connected to said front end assembly for hoisting said dipper, comprising at least one fluid actuated, working piston and cylinder assembly operatively interconnecting said body and said front end assembly whereupon selectively supplying fluid under pressure to opposite ends of the cylinder of said assembly, said front end system correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing in the charged condition a force applicable to a component of said front end assembly for biasing said component toward a predetermined movement, said crowd system including a mast pivotally connected at a lower end thereof to said body longitudinally, forwardly of a vertical center line of said body, a pair of transversely spaced support links pivotally connected at lower ends thereof to said body longitudinally, rearwardly of said vertical center line, a pair of crowd drive links pivotally connected at opposite ends thereof to said mast and said support links; and a pair of transversely spaced, fluid actuated working piston and cylinder assemblies pivotally connected at lower ends thereof to said body longitudinally, substantially at said vertical center line and pivotally connected at the opposite ends thereof to the pivotal connection between said support links and said crowd drive links.

29. A crowd system for a power shovel having a body; a front end assembly mounted on said body including a stiffleg pivotally connected to said body, a dipper handle operatively connected to said stiffleg and a dipper operatively connected to said dipper handle; and means mounted on said body and operatively connected to said front end assembly for hoisting said dipper, comprising at least one fluid actuated, working piston and cylinder assembly operatively interconnecting said body and said front end assembly whereupon selectively supplying fluid under pressure to opposite ends of the cylinder of said assembly, said front end system correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing in the charged condition a force applicable to a component of said front end assembly for biasing said component toward a predetermined movement, wherein said means for selectively supplying fluid under pressure to opposite ends of the cylinder of said working piston and cylinder assembly comprises a bidirectional, variable displacement pump and fluid supply lines operatively interconnecting said pump and opposite ends of said cylinder to provide a closed fluid circuit.

30. A crowd system according to claim 29 including means for replenishing fluid in said fluid lines.

31. A crowd system for a power shovel having a body; a front end assembly mounted on said body including a stiffleg pivotally connected to said body, a dipper handle operatively connected to said stiffleg and a dipper operatively connected to said dipper handle; and means mounted on said body and operatively connected to said front end assembly for hoisting said dipper, comprising at least one fluid actuated, working piston and cylinder assembly operatively interconnecting said body and said front end assembly whereupon selectively supplying fluid under pressure to opposite ends of the cylinder of said assembly, said front end system correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing in the charged condition a force applicable to a component of said front end assembly for biasing said component toward a predetermined movement, said crowd system including a second energy storing means and means responsive to a sudden decompression of fluid in said working piston and cylinder assembly for charging said second energy storing means.

32. A crowd system according to claim 31 including means for applying the force produced by said second energy storing means to a selected working component responsive to a predetermined condition.

33. A crowd system for a power shovel having a body; a front end assembly mounted on said body including a stiffleg pivotally connected to said body, a dipper handle operatively connected to said stiffleg and a dipper operatively connected to said dipper handle; and means mounted on said body and operatively connected to said front end assembly for hoisting said dipper, comprising at least one fluid actuated, working piston and cylinder assembly operatively interconnecting said body and said front end assembly whereupon selectively supplying fluid under pressure to opposite ends of the cylinder of said assembly, said front end system correspondingly will be caused to be lowered or raised, means for selectively supplying fluid under pressure to opposite ends of said cylinder, and an energy regeneration system including an energy storing means and means actuated by a predetermined movement of at least one component of said front end assembly for charging said energy storing means, said energy storing means providing in the charged condition a force applicable to a component of said front end assembly for biasing said component toward a predetermined movement wherein said fluid actuated, working piston and cylinder assembly includes a cylinder, a fixed piston mounted in said cylinder providing a first variable volume chamber defined by said fixed and movable pistons, a second variable volume chamber defined by said movable piston and said cylinder and a third variable volume chamber defined by said movable and fixed pistons and said cylinder; said means for selectively supplying fluid under pressure to opposite ends of said cylinder communicates with said first and second variable volume chambers; and said charging means includes said movable piston, operatively connected to said actuating component of said front end assembly and a closed hydraulic circuit intercommunicating said third chamber and said energy storing means.

34. A crowd system according to claim 33 wherein said closed hydraulic circuit includes a cutoff valve.

35. A crowd system according to claim 33 wherein said energy storing means comprises a hydro-pneumatic accumulator.

36. A crowd system according to claim 33 including a second energy storing means and means responsive to a sudden decompression of fluid in said working piston and cylinder assembly for charging said second energy storing means.

37. A crowd system according to claim 36 including means for communicating said second energy storing means selectively with one of said first and second variable volume chambers of said working piston and cylinder assembly responsive to predetermined conditions.

38. A crowd system according to claim 37 wherein said second energy storing means comprise a hydro-pneumatic accumulator.

39. A crowd system for a power shovel having a body; a front end assembly mounted on said body including a stiffleg pivotally connected to said body, a dipper handle operatively connected to said stiffleg and a dipper operatively connected to said dipper handle; and means mounted on said body and operatively connected to said front end assembly for hoisting said dipper, comprising a mast pivotally connected at a lower end thereof to said body, at least one connecting link pivotally connected at opposite ends thereof to said mast and said front end assembly, at least one support link pivotally connected at a lower end thereof to said body, a crowd drive link pivotally connected at opposite ends thereof to said mast and support link, and at least one fluid actuated, working piston and cylinder assembly pivotally connected at one end thereof to said body and pivotally connected at the opposite end thereof to one of said support link, crowd drive link and the pivotal connection between said support link and said crowd drive link, and means for selectively supplying fluid under pressure to opposite sides of the cylinder of said working piston and cylinder assembly.

40. A crowd system according to claim 39 wherein the pivotal connection of said mast to said body is disposed longitudinally, forwardly of a vertical center line of said body, the pivotal connection of said support link with said body is disposed longitudinally, rearwardly of said vertical center line and the pivotal connection between said working piston and cylinder assembly to said body is disposed longitudinally, substantially at said vertical center line.

41. An energy regeneration system for a power shovel having a body; a front end assembly mounted on said body including a dipper; means of hoisting said dipper; and means for crowding said dipper, comprising an energy storing means and means actuated by a predetermined movement of at least one component of said front end assembly for charging said energy storing means, said energy storing means providing in the charged condition a force applicable to a component of said front end assembly for biasing said component toward a predetermined movement, said energy regeneration system including a second energy storing means and means responsive to a sudden release of a load applied to a component of said front end assembly for charging said second energy storing means.

42. An energy regeneration system according to claim 41 including means for applying a force produced by said energy storing means to a selected working component responsive to a predetermined condition.

43. An energy regeneration system for a power shovel having a body; a front end assembly mounted on said body including a dipper; means for hoisting the dipper; and means for crowding the dipper, comprising an energy storing means responsive to a sudden release of a load applied to a component of said front end assembly for charging said energy storing means.

44. An energy regeneration system according to claim 43 including means for applying a force produced by said energy storing means to a selected component of said front end assembly.

* * * * *

UNITED STATES PATENT AND TRADEMARK OFFICE

CERTIFICATE OF CORRECTION

PATENT NO. : 4,046,270

DATED : September 6, 1977

INVENTOR(S) : George B. Baron et al

It is certified that error appears in the above-identified patent and that said Letters Patent are hereby corrected as shown below:

Col 2 line 25 delete "12" (first occurrence) and insert --22--.
Col 4 line 46 delete "94" and insert --96--.
Col 5 line 10 delete "18" and insert --108--.
Col 6 line 26 delete "and" (second occurrence).
Col 6 line 67 delete "maingframe" and insert --main frame--.
Col 7 line 33 delete "being" and insert --swing--.
Col 9 line 21 insert --and-- before "the".

Claim 1 line 21 delete "of" and insert --and--.
line 31, insert --in-- before "the".
Claim 2 line 51, delete "of" and insert --and--.
line 61, insert --in-- before "the".
Claim 4 line 27, delete "of" and insert --and--.
line 37, insert --in-- before "the".
Claim 6 line 59, delete "of" and insert --and--.
Column 12, (claim 6, line 1, insert -- end -- before "the".
Claim 7 line 1, insert --end -- before "assembly".
line 30, delete "of" and insert --and--.
line 40, insert --in-- before "the".

UNITED STATES PATENT AND TRADEMARK OFFICE

CERTIFICATE OF CORRECTION

PATENT NO. : 4,046,270

DATED : September 6, 1977

INVENTOR(S) : George B. Baron et al

It is certified that error appears in the above-identified patent and that said Letters Patent are hereby corrected as shown below:

Claim 17 line 31, delete "of" and insert --and--.
line 41, insert --in-- before "the".
Claim 18 line 6, delete "of" and insert --and--.
line 16, insert --in-- before "the".
line 29, delete "communicates" and insert --communicating--.
Claim 33 line 55, delete "communicates" and insert --communicating--.
Claim 41, line 3, delete "of" and insert --for--.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*